US008360749B2

(12) United States Patent
Morrone

(10) Patent No.: US 8,360,749 B2
(45) Date of Patent: Jan. 29, 2013

(54) ARRANGEMENT AND PROCESS FOR MOUNTING A RESONANT SPRING IN A REFRIGERATION COMPRESSOR

(75) Inventor: Rogerio Ribeiro Morrone, Joinville-Sc (BR)

(73) Assignee: Whirlpool S.A., São Paulo—Sp (BR)

( * ) Notice: Subject to any disclaimer, the term of this patent is extended or adjusted under 35 U.S.C. 154(b) by 353 days.

(21) Appl. No.: 12/809,121

(22) PCT Filed: Dec. 8, 2008

(86) PCT No.: PCT/BR2008/000364

§ 371 (c)(1), (2), (4) Date: Aug. 24, 2010

(87) PCT Pub. No.: WO2009/076734

PCT Pub. Date: Jun. 25, 2009

(65) Prior Publication Data

US 2010/0310396 A1 Dec. 9, 2010

(30) Foreign Application Priority Data

Dec. 18, 2007 (BR) ..... 0705541

(51) Int. Cl.

| | |
|---|---|
| ***F04B 17/03*** | (2006.01) |
| ***F04B 35/04*** | (2006.01) |
| ***B21D 53/06*** | (2006.01) |
| ***B21K 21/00*** | (2006.01) |
| ***F01B 31/00*** | (2006.01) |

(52) U.S. Cl. ..... 417/360; 417/416; 29/890.035; 92/130 R

(58) Field of Classification Search ..... 29/888.02, 29/890.035, 898.07, 888.09; 267/166, 167, 267/170, 174, 178, 179; 188/380; 417/53, 417/360, 470, 471, 416, 902; 92/130 C, 92/130 R See application file for complete search history.

(56) References Cited

U.S. PATENT DOCUMENTS 1,390,948 A * 9/1921 Woodward ..... 152/105

(Continued)

FOREIGN PATENT DOCUMENTS

EP 0494653 A1 7/1992
EP 1686264 A1 8/2006

(Continued)

*Primary Examiner* — Devon Kramer
*Assistant Examiner* — Bryan Lettman
(74) *Attorney, Agent, or Firm* — Gifford, Krass, Sprinkle, Anderson & Citkowski, P.C.

(57) ABSTRACT

The arrangement and the process are applied in a compressor comprising: a cylinder block (2); a movable assembly including a piston (5); and a resonant spring (11) having a first end portion (11*a*), affixed to the cylinder block (2) by a first fixation assembly (20), and a second end portion (11*b*) affixed to the movable assembly by a second fixation assembly (30). The first or the second fixation assembly (20, 30) comprises a bearing portion (21, 31) attached around one of the end portions (11*a*, 11*b*) of the resonant spring (11) and having a fixation face (21*b*, 31*b*), and a bearing receiving portion (22, 32), previously attached to the cylinder block (2) or to the movable assembly and having a junction face (22*b*, 32*b*), the fixation and junction faces (21*b*, 31*b*, 22*b*, 32*b*) being welded together, securing the resonant spring (11) to the movable assembly and to the cylinder block (2), maintaining the movable assembly concentric to the cylinder (2*a*) and in a predetermined axial positioning.

21 Claims, 6 Drawing Sheets

U.S. PATENT DOCUMENTS

| | | | | |
|---|---|---|---|---|
| 6,174,141 | B1 | 1/2001 | Song et al. | |
| 7,591,638 | B2 * | 9/2009 | Lee et al. | 417/415 |
| 2005/0158193 | A1 * | 7/2005 | Roke et al. | 417/417 |
| 2005/0175473 | A1 * | 8/2005 | Park et al. | 417/363 |
| 2006/0251529 | A1 * | 11/2006 | Kim | 417/417 |
| 2008/0213109 | A1 * | 9/2008 | Patel et al. | 417/417 |
| 2008/0219868 | A1 * | 9/2008 | Bonniface et al. | 417/415 |

FOREIGN PATENT DOCUMENTS

| | | | |
|---|---|---|---|
| WO | WO-02095232 | A1 | 11/2002 |

* cited by examiner

ARRANGEMENT AND PROCESS FOR MOUNTING A RESONANT SPRING IN A REFRIGERATION COMPRESSOR

FIELD OF THE INVENTION

The present invention refers to an arrangement and a process for mounting a resonant spring in a refrigeration compressor of the type driven by a linear motor and, more particularly, to an arrangement and process for mounting a resonant spring of the type which couples a piston-driving rod-actuating means assembly to a cylinder block of the refrigeration compressor.

PRIOR ART

The refrigeration compressors driven by an electric motor of the linear type generically comprise, in the interior of a generally hermetic shell, a non-resonant assembly including a cylinder (usually manufactured in the form of a block), to which is also attached the linear motor and in whose interior is defined a compression chamber having an end generally closed by a valve plate and by a head, and an open opposite end through which is mounted a piston reciprocating in the interior of the compression chamber and which is coupled, usually through a driving rod, to a driving means (defined by an actuating means which carries magnets energized by the electric motor) mounted to the cylinder block.

The linear motor is responsible for generating the necessary thrust to displace the piston in the interior of the cylinder compression chamber and, consequently, for compressing the refrigerant fluid, in the form of gas, in the compressor.

To the piston—driving rod—actuating means assembly is coupled a resonant spring means, mounted in such a way as to exert opposite axial forces on the piston, upon its reciprocating axial displacement, in the interior of the compression chamber, provoked by the driving means. The resonant spring means operates as a guide for the axial displacement of the piston, causing the compressor assembly defined by the piston, driving rod and actuating means to actuate, permitting the linear motor to be dimensioned to continuously supply energy to the compressor upon operation.

The compressor assembly and the resonant spring means define a resonant assembly of the compressor.

In some linear compressor constructions, the spring means includes a resonant spring having a first end portion affixed to the compressor assembly (generally to the actuating means) by a first fixation means, and a second end portion affixed to the non-resonant assembly, for example, to the cylinder block or to the supporting structure thereof, by a second fixation means, said fixation means including fixation portions retained to each other, generally by screws (FIG. 1). Such retention presents some disadvantages, such as the possibility of gap formation and requirement of precise dimensioning.

In these constructions, the dimensioning and the mounting of the parts defined by the piston, driving rod, actuating means and resonant spring should be made so that the piston be displaced to the nearest position in relation to the valve plate when in the upper dead point condition, i.e., in the compression stroke end condition, in order to make minimal the dead volume of refrigerant gas in the interior of the compression chamber and, thus, minimize the efficiency losses of the compressor. However, the distance between the piston top, when in the mounting position, and the valve plate should be such as to define adequate volumetric displacement and refrigeration capacity.

The two following mounting conditions are fundamental for the correct functioning of the compressor: in the first place, the relative position of the piston top in relation to the cylinder top closed by the valve plate, in the mounting or resting condition of the piston, which condition will define the compressor capacity and variability; and, in the second place, the alignment of the piston in relation to the cylinder, which will define the loading on the (oil or pneumatic) bearing. It should be considered that, for obtaining the correct distance from the piston top to the cylinder top during the mounting process, there is a chain of tolerances which should be maintained in very low levels, so that the final tolerance of the mentioned distance is maintained within acceptable levels. Furthermore, for obtaining the correct alignment of the piston in relation to the cylinder, the tolerances orthogonal to the main shaft of the compressor are required to be maintained in the same low levels. This implies high costs for manufacturing the components.

The piston is coupled to the driving means to permit forces to be transferred therebetween and to make the piston be displaced in the interior of the compression chamber, according to an axial direction coincident with the axis of said compression chamber, in order to minimize the transversal reaction forces of the cylinder block against the piston in the interior of the compression chamber. Such transversal reaction forces of the cylinder block against the piston can provoke excessive friction between the piston and the cylinder block, leading: to an increase of energy consumption, with consequent reduction of the compressor efficiency; to an accelerated wear of the components submitted to the highest friction levels, reducing the useful life of the compressor; and to the presence of noise, due to friction.

As a function of the problems aforementioned, it is desirable to provide a mounting arrangement of the parts defined by the piston-driving rod-actuating means and cylinder block, which guarantees the alignment of the piston to the cylinder axis and also a correct positioning of the piston top in relation to the cylinder top closed by the valve plate, in the mounting or resting condition of the piston.

SUMMARY OF THE INVENTION

It is a generic object of the present invention to provide an arrangement for mounting a resonant spring in a refrigeration compressor, of the type considered above and which does not require very tight tolerances of the involved components, in the directions parallel and orthogonal to the main axis of the piston and of the cylinder, in such a way that, even with more open tolerances, a correct positioning of the piston in the interior of the cylinder is obtained with an adequate alignment therebetween.

Another object of the present invention is to provide a mounting arrangement as cited above and which guarantees, upon mounting the piston to the cylinder, a desirable distance between the piston top and the cylinder top closed by the valve plate, and which results in an adequate capacity.

A further object of the present invention is to provide a mounting arrangement as cited above, which presents a simple and low cost mounting between the parts defined by the piston and driving rod to the actuating means.

In order to comply with the object cited above, the present invention provides an arrangement for mounting a resonant spring in a refrigeration compressor of the type which comprises, in the interior of a shell: a cylinder block defining a cylinder; a movable assembly formed by a piston reciprocating in the interior of the cylinder, an actuating means for driving the piston, and a driving rod coupling the piston to the actuating means; and a resonant spring having a first end portion affixed to the cylinder block by a first fixation means, and a second end portion affixed to the movable assembly by a second fixation means, in said mounting arrangement at least one of the first and second fixation means comprising a bearing portion which is previously attached, at a first side, around one of the end portions of the resonant spring and having, at an opposite side, a fixation face, and a bearing receiving portion, which is previously attached, at one side, to one of the parts of cylinder block and movable assembly, and having, at an opposite side, a junction face, said fixation and junction faces of the bearing portion and bearing receiving portion of said fixation means being seated and welded to each other, in order to attach the respective end portion of the resonant spring to one of the parts of movable assembly and cylinder block, maintaining said movable assembly concentric to the cylinder and in a predetermined axial positioning.

The resonant spring mounting arrangement of the present invention is carried out according to a mounting process which comprises the steps of: affixing a bearing portion of one of the first and second fixation means around one of the end portions of the resonant spring, said bearing portion having a fixation side and an opposite side with a fixation face; affixing a first side of a corresponding bearing receiving portion in one of the parts of cylinder block and movable assembly, said bearing receiving portion having a junction face opposite to the first side; and mutually seating and welding the fixation and junction faces, so as to attach the respective end portion of the resonant spring to one of the parts of movable assembly and cylinder block, maintaining said movable assembly concentric to the cylinder and in a predetermined axial positioning.

BRIEF DESCRIPTION OF THE DRAWINGS

The invention will be described below, with reference to the enclosed drawings, given by way of example of embodiments of the invention and in which.

DETAILED DESCRIPTION OF THE INVENTION

As aforementioned, the resonant spring mounting arrangement of the present invention will be described for a construction of refrigeration compressor driven by a linear motor. However, it should be understood that the present solution can be applied to other constructions using spring elements in refrigeration compressors in general.

Figure 1:
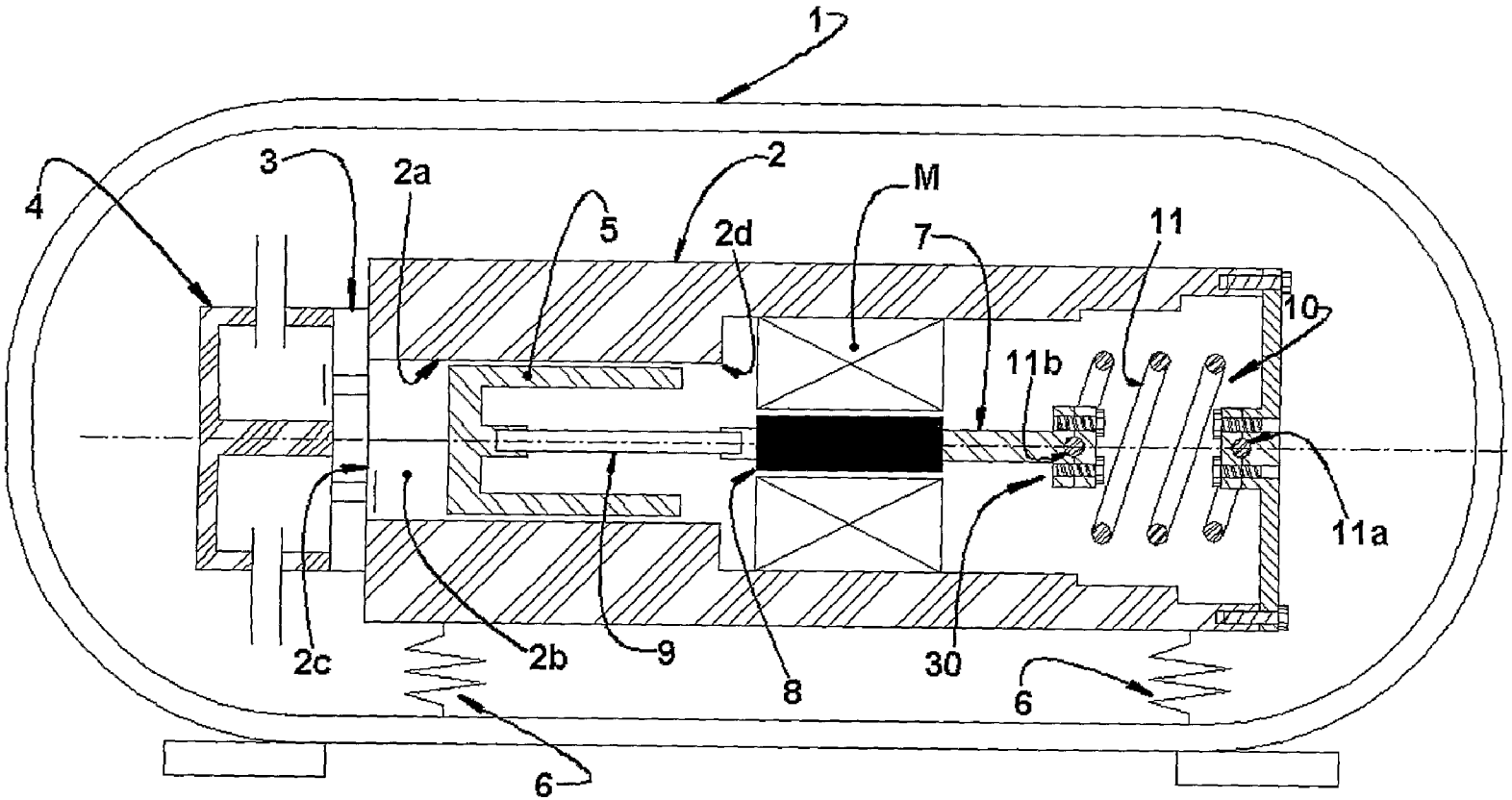
FIG. 1 PRIOR ART
FIG. 1 represents a schematic simplified longitudinal sectional view of a refrigeration compressor driven by a linear motor and having a mounting arrangement for mounting the resonant spring to the parts of compressor assembly and non-resonant assembly according to a prior art construction.
Figure 2:
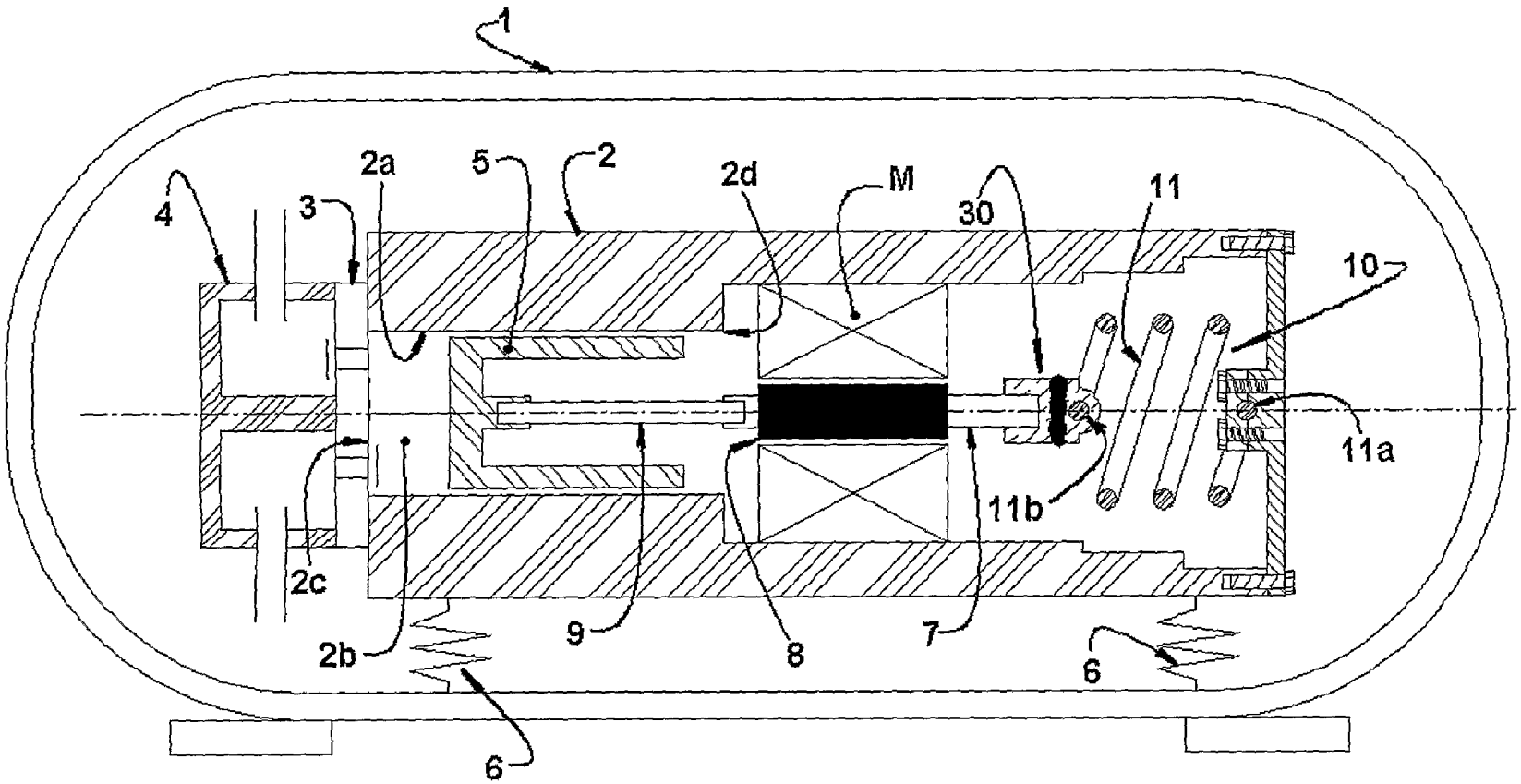
FIG. 2 represents a schematic simplified longitudinal sectional view of the refrigeration compressor of FIG. 1, illustrating a way of carrying out the present invention.
Figure 3:
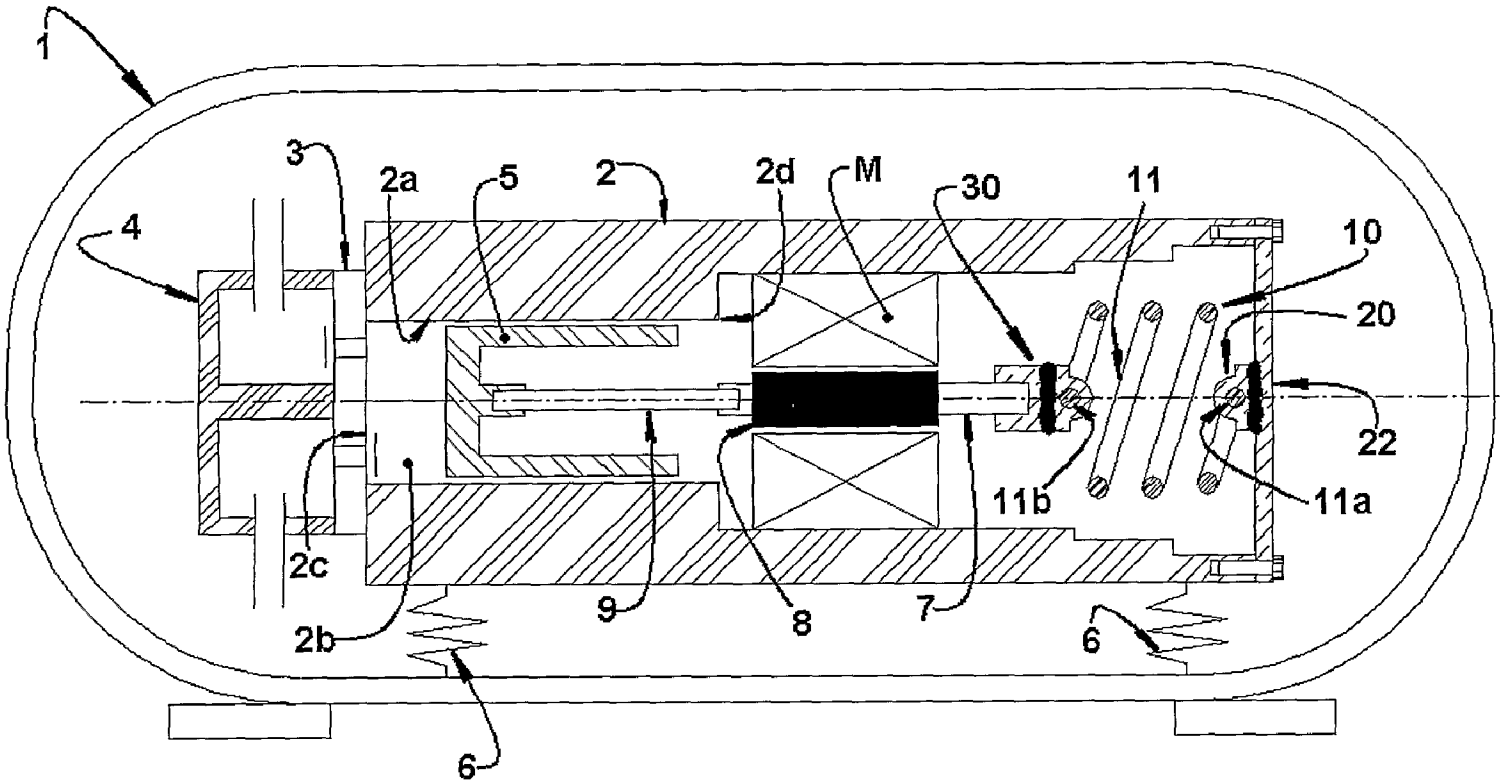
FIG. 3 represents a schematic simplified longitudinal sectional view of the refrigeration compressor of FIG. 2, illustrating another way of carrying out the present invention.
Figure 4:
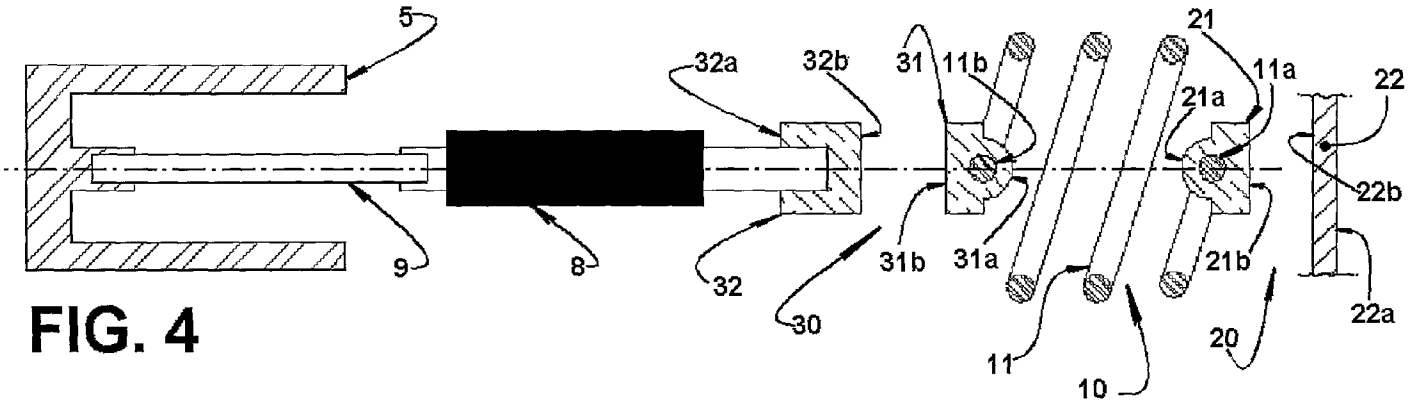
FIGS. 4 and 4*a* represent, respectively, schematic simplified longitudinal sectional views of a resonant spring to be attached to the parts of compressor assembly and non-resonant assembly of the refrigeration compressor, according to the present invention, which views are offset from each other by 90°.
Figure 4A:
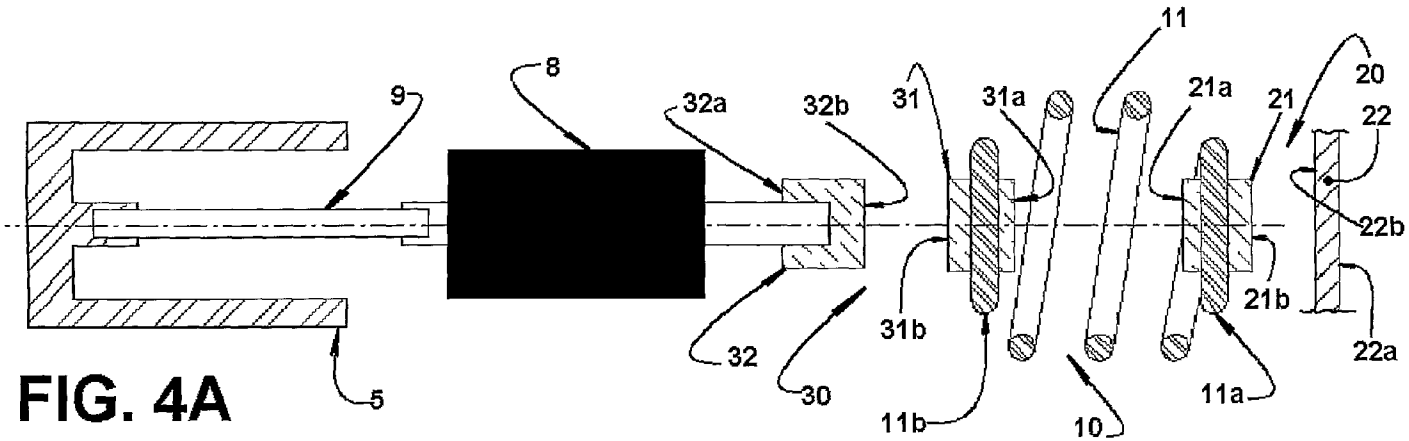

According to the illustrations in FIGS. 1-3, the refrigeration compressor, to which the resonant spring mounting arrangement of the present invention will be applied, comprises, in the interior of a generally hermetic shell 1, a cylinder block 2 in which is provided a cylinder 2*a* internally defining a compression chamber 2*b*, having an end 2*c* closed by a valve plate 3 and a head 4, and an open opposite end 2*d* through which is mounted a piston 5, which is operatively coupled to a linear electric motor M. In the illustrated construction, the cylinder block 2 is mounted to the shell 1 through a suspension means 6, generally in the form of springs, such as helical springs of the illustrated type.

The piston 5 is coupled to an actuating means 7 which carries magnets 8 energized by the electric motor M, through a driving rod 9. The piston 5, the driving rod 9 and the actuating means 7 (and magnets 8) define a movable assembly of the compressor.

To the piston 5-driving rod 9-actuating means 7 assembly is coupled a resonant spring means 10, which is mounted in such a way as to exert opposite axial forces on the piston 5, upon its reciprocating axial displacement in the interior of the compression chamber 2*b*, provoked by a driving means which comprises the actuating means 7 and the magnets 8. The resonant spring means 10 operates as a guide for the axial displacement of the, piston 5, making the movable assembly defined by the piston 5-driving rod 9-actuating means 7 actuate, allowing the linear electric motor M to be dimensioned to continuously supply energy to the compressor upon operation.

The movable assembly and the resonant spring means 10 define a resonant assembly of the compressor.

The resonant spring means 10 can present different constructions comprising one or more resonant springs 11. In the illustrated construction of refrigeration compressor, the resonant spring means 10 includes a resonant spring 11 having a first end portion 11*a* affixed to the non-resonant assembly, for example, to the cylinder block 2 or to the supporting structure thereof, by a first fixation means 20, and a second end portion 11*b* affixed to the movable assembly (generally to the actuating means 7) by a second fixation means 30.

According to the illustrated construction of resonant spring 11, each end portion 11*a*, 11*b*, of the resonant spring 11 is disposed according to a direction orthogonal to the axis of the resonant spring 11. However, it should be understood that the present invention, as described below, can be applied in different constructions of end portion 11*a*, 11*b* of a resonant spring 11, such as, for example, with at least one of said end portions 11*a*, 11*b* being parallel to said axis of the resonant spring 11.

According to the present invention, at least one of the first and second fixation means 20, 30 comprises a bearing portion 21, 31, previously attached, at a first side 21*a*, 31*a*, around one of the first and second end portions 11*a*, 11*b* of the resonant spring 11 and having, at an opposite side, a fixation face 21*b*, 31*b*, and a bearing receiving portion 22, 32, previously attached, at one side 22*a*, 32*a*, to one of the parts of cylinder block 2 and movable assembly, and having, at an opposite side, a junction face 22*b*, 32*b*. Said fixation face 21*b*, 31*b* and junction face 22*b*, 32*b* of the bearing portion 21, 31 and bearing receiving portion 22, 32 of said fixation means 20, 30 are seated and welded to each other, in order to secure the respective end portion 11*a*, 11*b* of the resonant spring 11 to one of the parts of movable assembly and cylinder block 2, maintaining said movable assembly concentric to the cylinder 2*a* and in a predetermined axial positioning.

According to a way of carrying out the present invention, the fixation face 21*b*, 31*b* and junction face 22*b*, 32*b* of the bearing portion 21, 31 and bearing receiving portion 22, 32 of said fixation means 20, 30 are welded to each other by fusion, being deformed by mutual compression, during the fusion-welding process. The fixation by fusion can be obtained by heating one or both the fixation face 21*b*, 31*b* and junction face 22*b*, 32*b*, to be directly welded to each other, or said fusion can be obtained by disposing, between said fixation face 21*b*, 31*b* and junction face 22*b*, 32*b*, an additional element to be used in the hot or cold fusion of said parts.

In the illustrated construction, each end portion 11*a*, 11*b*, of the resonant spring 11 defines a circular section shaft portion which is tightly housed in the interior of a respective bearing portion of one of the first and second fixation means. However, it should be understood that the present invention is not limited to the profile of the resonant spring 11. The mounting arrangement presented herein can be also applied to end portions 11*a*, 11*b* of the resonant spring 11 presenting a profile different from the circular one described and illustrated herein.

In a particular form of the present invention, the mounting arrangement presented herein is carried out so as to allow the piston 5 to be concentrically mounted in the interior of the cylinder 2*a*, said concentricity being maintained during operation of the compressor, preventing impacts of the piston 5 against the inner surface of the cylinder 2*a*. The present mounting arrangement also permits adjusting the relative axial positioning of the piston 5 in relation to the top of cylinder 2*a*, which guarantees a previously calculated and desired volumetric displacement and refrigeration capacity to be reached during the operation of the compressor.

According to FIG. 2, the mounting arrangement of the present invention comprises only the second fixation means 30 having the respective bearing portion 31 disposed surrounding an adjacent end portion 11*b* of the resonant spring 11, the corresponding bearing receiving portion 32 being previously attached, surrounding an adjacent end of the actuating means 7, which is an extension of the driving rod 9. It should be understood that the bearing receiving portion 32 of the second fixation means 30 can be directly molded surrounding an adjacent end of the driving rod 9 or even of the piston 5, in the constructions in which the resonant spring means 10 is directly affixed to one of said parts.

In the construction illustrated in FIG. 3, the mounting arrangement of the present invention further comprises the first fixation means 20, which has its bearing portion 21 provided surrounding an adjacent end portion 11*a* of the resonant spring 11 and the bearing receiving portion 22 being molded surrounding an adjacent surface portion of the cylinder block 2, although said bearing receiving portion 22 can be defined by an adjacent surface portion of the cylinder block 2, coaxial to the axis of the cylinder 2*a*. In this case, said adjacent surface portion of the cylinder block 2 is made of a material compatible with the welding to be applied thereto for fixation to an adjacent bearing portion 21 of the first fixation means 20. In the illustrated construction, the first fixation means 20 has the bearing receiving portion 22 defining an end wall to the cylinder block 2, and being attached to an adjacent end thereof, for example, by screws.

In the mounting arrangement of the present invention, at least one of the parts of bearing portion 21, 31 and bearing receiving portion 22, 32 is molded directly on the respective part of the end portion 11*a*, 11*b* of the resonant spring 11, of the cylinder block 2 and of the movable assembly. In the illustrated construction of second fixation means 30, each of said parts of bearing portion 31 and bearing receiving portion 32 is molded on the respective part of adjacent end portion 11*b* of the resonant spring 11 and adjacent end of the actuating means 7.

According to a particular form of the present invention, each bearing portion 21, 31 and bearing receiving portion 22, 32 is over-injected on the respective part in which it is provided, said parts of bearing portion 21, 31 and bearing receiving portion 22, 32 being made, for example, of the same material and, more particularly, obtained in plastic material, for example, nylon.

In the illustrated construction, the bearing receiving portion 22 of the first fixation means 20 is defined by a portion of the cylinder block 2 attached to a portion thereof opposite to that in which the cylinder 2*a* is defined, said portion of the cylinder block 2 being in a material compatible with the fusion of the bearing portion 31, as already described, as well as in a plastic material, such as that of said bearing portion 21 of the first fixation means 20.

The mounting arrangement of the present invention is obtained through a process for mounting the resonant spring 11 in a refrigeration compressor of the above-described-type, comprising the generic steps of: affixing a bearing portion 21, 31, of one of the first and second fixation means 20, 30 around one of the end portions 11*a*, 11*b* of the resonant spring 11, said bearing portion 21, 31 having a first side, for fixation to the end portion 11*a*, 11*b* of the resonant spring 11, and an opposite side with a fixation face 21*b*, 31*b*; affixing a first side of a corresponding bearing receiving portion 22, 32, to one of the parts of cylinder block 2 and movable assembly, said bearing receiving portion 22, 32 having a junction face 22*a*, 22*b* opposite to the first side; and mutually seating and welding the fixation face 21*b*, 31*b* and junction face 22*b*, 32*b*, so as to secure the respective end portion 11*a*, 11*b* of the resonant spring 11 to one of the parts of movable assembly and cylinder block 2, maintaining said movable assembly concentric to the cylinder 2*a* and in the predetermined axial positioning previously described. In a way of carrying out the present invention, said processing steps are effected in the sequence presented above.

In the step of affixing each bearing portion 21, 31 to an adjacent end portion 11*a*, 11*b* of the resonant spring 11, the present process is carried out by molding, by over-injecting, each bearing portion 21, 31 on the part to which it will be simultaneously or sequentially attached. The bearing receiving portion 22 is also molded, by over-injection, to the movable assembly, particularly to an adjacent end of the actuating means 7, as already described.

After the fixation of the bearing portions 21, 31, the present process generically and sequentially presents the additional steps of: heating at least one of the parts of fixation face 21*b*, 31*b* and junction face 22*b*, 32*b* of a bearing portion 21 and a bearing receiving portion 31 to be attached to each other; positioning said parts to each other, so as to obtain a coaxial positioning of the movable assembly in relation to the cylinder 2*a*; mutually seating said parts; and compressing said parts of fixation face 21*b*, 31*b* and junction face 22*b*, 32*b*, until obtaining a determined surface fusion thereof, corresponding to the predetermined axial positioning cited above.

In the illustrated constructions, the movable assembly comprising the piston 5, the driving rod 9 and the actuating means 7 with the magnets 8 is positioned in an adequate device, as well as the resonant spring 11. In this condition and with the second fixation means 30 being already molded in the respective parts of movable assembly and resonant spring 11, there is initiated the heating of both the bearing portion 31 and the bearing receiving portion 32 of said second fixation means 30, until the respective fixation face 31*b* and junction face 32*b* are softened by fusion. At this moment, said fixation face 31*b* and junction face 32*b* are mutually seated and compressed, until obtaining the plastic welding thereof. Since the two parts are positioned in a mounting device which guarantees the final position of the piston and its alignment in relation to the axis of the cylinder 2*a*, after the end of the process of welding and mutual fixation of the bearing portion 31 to the respective bearing receiving portion 32 of the second fixation means 30, the movable assembly and the resonant spring 11 can be both mutually mounted in the compressor, with the parts of bearing portion 21 and bearing receiving portion 22 of the first fixation means 20 being submitted to heating until they are softened and fused, before being seated and compressed for obtaining the fixation, by fusion, between the respective fixation face 21*b* and junction face 22*b*. In this mounting to the compressor, the cylinder block 2 itself can be used as a guide, and the bearing portion of the first fixation means 20 can be directly attached to an adjacent portion of the cylinder block 2.

Figure 5:
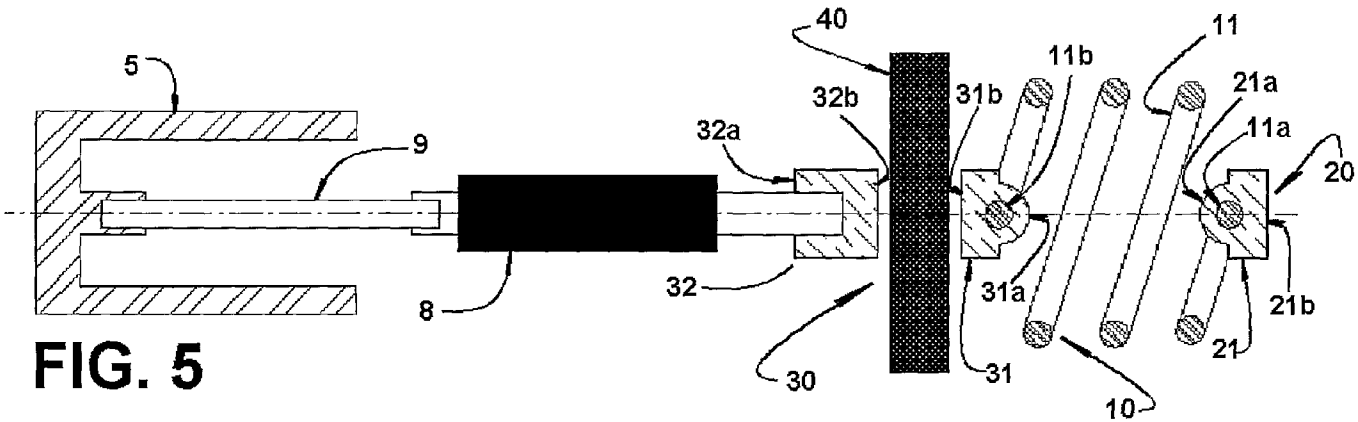
FIGS. 5 and 5*a* represent, respectively, schematic views such as those of FIGS. 4 and 4*a*, illustrating a welding element disposed between the resonant spring and the driving rod of the compressor assembly.
Figure 5A:
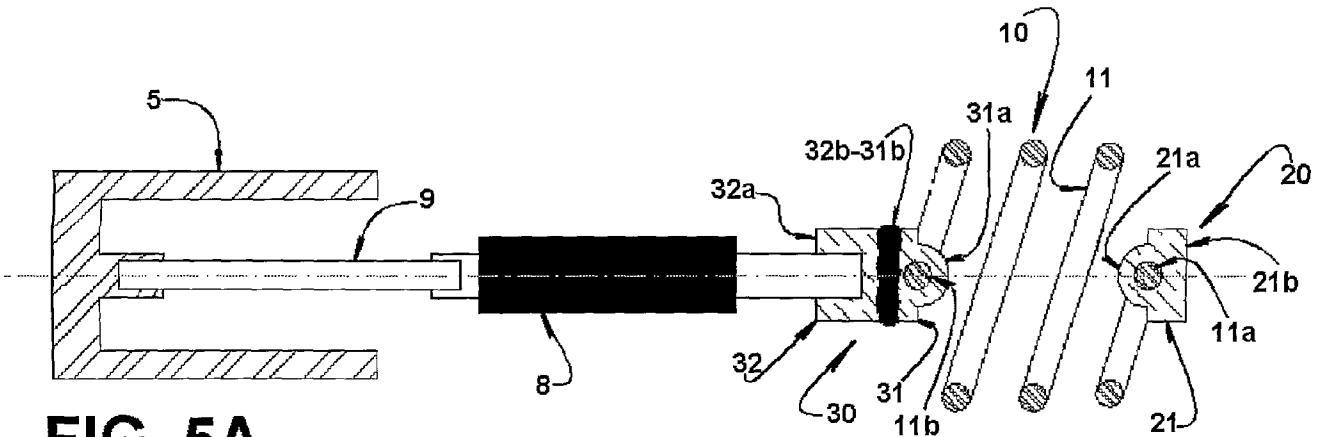

In a particular form of the present invention and according to the illustrations in FIGS. 5 and 5*a*, the present process comprises, after molding each bearing portion 21, 31 and bearing receiving portion 22, 32, on the respective part in which they are carried, the additional steps of: providing a heat source 40, such as, for example, a hot plate, between each bearing portion 21, 31 and respective bearing receiving portion 22, 32, before the heating of the respective fixation face 21*b*, 31*b* and junction face 22*b*, 32*b*; heating said fixation face 21*b*, 31*b* and junction face 22*b*, 32*b* through the heat transfer from the heat source 40 to said parts, until obtaining the fusion thereof, before they are mutually seated under axial compression, in order to obtain the welding between said parts in the desired relative axial positioning of the piston 5 in relation to the top of cylinder 2*a*. The heat source 40 can be in the form of a plate in a material compatible with the fusion to be carried out, and maintained between the parts to be fused, integrating the fixation means under mounting process with the fusion, or said plate can be mounted only to obtain the heating of the fixation and junction faces. Said plate is removed from the region between said parts, after they are heated, to permit the mutual hot seating, and the fusion, according to the embodiment illustrated in FIGS. 5 and 5*a*.

Figure 6:
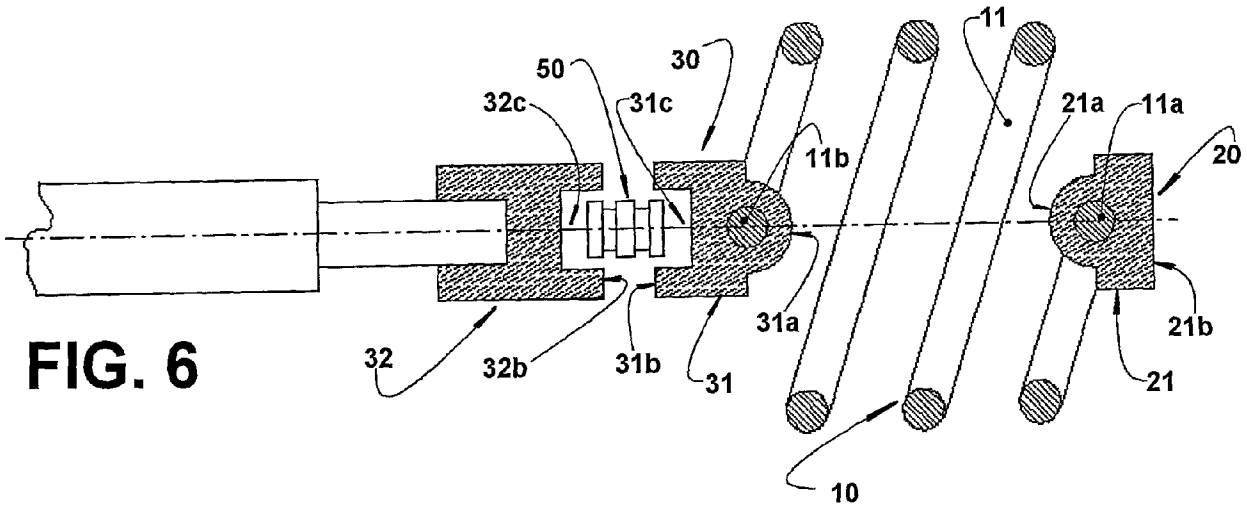
FIGS. 6 and 6*a* represent, respectively, schematic views, such as those of FIGS. 5 and 5*a*, illustrating another fixation form between the resonant spring and the driving rod of the compressor assembly.
Figure 6A:
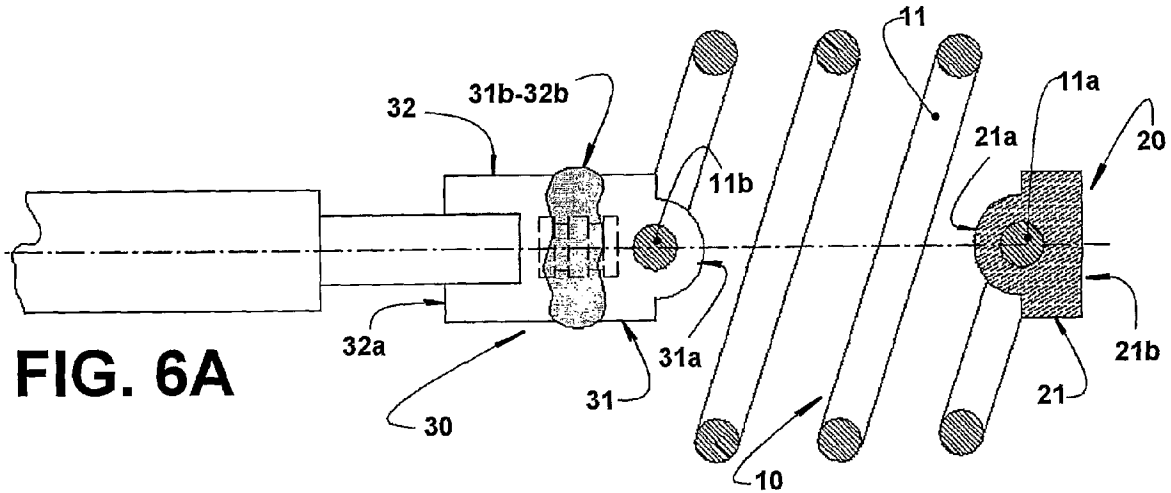

In another way of carrying out the present invention and according to the illustrations in FIGS. 6 and 6*a*, the process presented herein comprises, after molding each bearing portion 21, 31 and bearing receiving portion 22, 32, on the respective part that carries it, the additional steps of: providing the fixation element 50 between each bearing portion 31 and respective bearing receiving portion 32, before heating the respective fixation face 31*b* and junction face 32*b*; positioning said parts to each other, so as to obtain a coaxial positioning of the movable assembly in relation to the cylinder 2*a*; conducting said bearing portion 31 and respective bearing receiving portion 32 to the mutual seating; heating said fixation face 31*b* and junction face 32*b*, until obtaining the fusion thereof around the fixation element 50 and to each other, so as to obtain the predetermined axial positioning between the parts of cylinder and piston.

The heating can be carried out, for example, with the application of an induction field in the mutual seating region between the fixation face 31*b* and junction face 32*b* of the bearing portion 31 and bearing receiving portion 32.

Although this other way of carrying out fixation is illustrated only for the bearing portion 31 and bearing receiving portion 32 of the second fixation means 30, it should be understood that this process can also be applied to the first fixation means 20.

The fixation element 50 can be in the form of a pin (flat or provided with superficial grooves, preferably circumferential) made of a material whose fusion point is much superior to that of the parts of bearing portion 31 and bearing receiving portion 32 to be attached to each other, so that it can be axially maintained between the parts to be fused, actuating as a mechanical anchoring element for the fixation means under a fusion mounting process. The fixation element 50 can also actuate, before the fusion of the bearing portion 31 and bearing receiving portion 32, as a mounting guide element between said parts.

For this type of fixation construction, each one of the fixation face 31*b* and junction face 32*b* of the bearing portion 31 and bearing receiving portion 32 is provided with a respective recess 31*c*, 32*c*, of calculated height, in a way in which gaps between the fixation element 50 and said bearing portion 31 and bearing receiving portion 32 are filled with the fusion of the fixation face 31*b* and junction face 32*b*.

In a way of carrying out the fixation in this embodiment, the fixation element 50 is provided in a high thermal conductibility material, for example metal, which, when heated, emanates heat and also heats the bearing portion 31 and bearing receiving portion 32, in the region of the fixation face 31*b* and junction face 32*b*, resulting in the fusion thereof.

In this construction, the fixation element 50 generically actuates as the heat source 40 already described. In this case, the heat source internal to the fixation means presenting its bearing portion 31 and bearing receiving portion 32, is heated by another heat source, external to said bearing portion 31 and bearing receiving portion 32. The processing steps already described for the fixation using the heat source 40 are also valid for this construction presenting the fixation element 50.

At the end of the fusion process, the fixation element remains housed between the recesses 31*c*, 32*c*, exerting the function of a mechanical anchorage element of the parts fused to each other.

The fixation process described herein is carried out in an adequate mounting device, which guarantees the correct positioning between the parts.

The mounting arrangement of the present invention does not require very precise tolerances of the components to be mounted to each other, both in the direction of the axis of the cylinder block 2 and in the direction orthogonal to said axis, without compromising the concentric positioning of the movable assembly in relation to the axis of the cylinder, as well as in relation to the distance between a piston top portion in relation to the valve plate and which defines the volume displaced and the corresponding refrigeration capacity of the compressor.

The invention claimed is:

1. An arrangement for mounting a resonant spring in a refrigeration compressor of a type which comprises, in an interior of a shell (1): a cylinder block (2) defining a cylinder (2*a*); a movable assembly formed by a piston (5) reciprocating in an interior of the cylinder (2*a*), an actuating means (7), for driving the piston (5), and a driving rod (9) coupling the piston (5) to the actuating means (7); and a resonant spring (11) having a first end portion (11*a*) affixed to the cylinder block (2) by a first fixation means (20), and a second end portion (11*b*) affixed to the movable assembly by a second fixation means (30), wherein at least one of the first and second fixation means (20, 30) comprises a bearing portion (21, 31) which is attached, at a first side (21*a*, 31*a*), around one of the end portions (11*a*, 11*b*) of the resonant spring (11)

and having, at an opposite side, a fixation face (21*b*, 31*b*), and a bearing receiving portion (22, 32) which is attached, at one side, to one of the cylinder block and the movable assembly and having, at an opposite side, a junction face (22*b*, 32*b*), said fixation and junction faces (21*a*, 31*a*, 22*b*, 32*b*) of the bearing portion (21, 31) and bearing receiving portion (22, 32) of said fixation means (20, 30) being seated and welded to each other, in order to secure a respective end portion (11*a*, 11*b*) of the resonant spring (11) to the one of the movable assembly and the cylinder block (2), maintaining said movable assembly concentric to the cylinder (2*a*) and in a predetermined axial positioning.

2. The arrangement, as set forth in claim 1, wherein at least one of the parts of the bearing portion (21, 31) and the bearing receiving portion (22, 32) are molded directly onto a respective part of one of the end portions (11*a*, 11*b*) of the resonant spring (11), of the cylinder block (2) and of the movable assembly.

3. The arrangement, as set forth in claim 2, wherein each bearing portion (21, 31) and bearing receiving portion (22, 32) is over-injected on a respective part to which it is provided.

4. The arrangement, as set forth in claim 2, wherein each end portion (11*a*, 11*b*) of the resonant spring (11) is disposed according to a direction orthogonal to an axis of said resonant spring (11).

5. The arrangement, as set forth in claim 2, wherein each end portion (11*a*, 11*b*) of the resonant spring (11) defines a circular section shaft portion tightly housed in the interior of a respective bearing portion (21, 31) of one of the first and second fixation means (20, 30).

6. The arrangement, as set forth in claim 1, wherein the fixation face (21*b*, 31*b*) and junction face (22*b*, 32*b*) of the bearing portion (21, 31) and bearing receiving portion (22, 32) of said fixation means (20, 30) are fusion welded to each other.

7. The arrangement, as set forth in claim 6, wherein the fixation face (21*b*, 31*b*) and junction face (22*b*, 32*b*) of the bearing portion (21, 31) and bearing receiving portion (22, 32) of said fixation means (20, 30) are deformed by mutual compression during fusion welding.

8. The arrangement, as set forth in claim 6, wherein parts of the bearing portion (21, 31) and the bearing receiving portion (22, 32) are fusion welded to each other around a fixation element (50) made of a material with a fusion point higher than that of said parts of the bearing portion (21, 31) and the bearing receiving portion (22, 32).

9. The arrangement, as set forth in claim 8, wherein the fixation element (50) is a pin axially housed in recesses (31*c*, 32*c*) defined in each one of the fixation face (31*b*) and junction face (32*b*) of the parts of the bearing portion (21, 31) and the bearing receiving portion (22, 32).

10. The arrangement, as set forth in claim 9, wherein the fixation element (50) is a metallic pin.

11. The arrangement, as set forth in claim 9, wherein the pin is provided with superficial grooves.

12. The arrangement, as set forth in claim 1, wherein the parts of the bearing portion (21, 31) and the bearing receiving portion (22, 32) are made of a same material.

13. The arrangement, as set forth in claim 12, wherein the parts of the bearing portion (21, 31) and the bearing receiving portion (22, 32) are made of plastic material.

14. The arrangement, as set forth in claim 1, wherein the bearing receiving portion (32) of the second fixation means (30) is molded, in a single piece, around the driving rod (9).

15. A process for mounting a resonant spring in a refrigeration compressor of a type which comprises, in an interior of a shell (1): a cylinder block (2) defining a cylinder (2*a*); a movable assembly formed by a piston (5) reciprocating in an interior of the cylinder (2*a*), by an actuating means (7) for driving the piston (5), and by a driving rod (9) coupling the piston (5) to the actuating means (7); and a resonant spring (11) having a first end portion (11*a*) affixed to the cylinder block (2) by a first fixation means (20), and a second end portion (11*b*) affixed to the movable assembly by a second fixation means (30), it comprising the steps of:

affixing a bearing portion (21, 31) of one of the first and second fixation means (20, 30) around one of the end portions (11*a*, 11*b*) of the resonant spring (11), said bearing portion (21, 31) having a fixation side (21*a*, 31*a*) and an opposite side with a fixation face (21*b*, 31*b*);

affixing a first side (21*a*, 31*a*) of a corresponding bearing receiving portion (22, 32) to one of the cylinder block (2) and the movable assembly, said bearing receiving portion (22, 32) having a junction face (22*b*, 32*b*) opposite to the first side; and mutually seating and welding the fixation and junction faces (21*b*, 31*b*, 22*b*, 32*b*), so as to affix a respective end portion (11*a*, 11*b*) of the resonant spring (11) to the one of the movable assembly and the cylinder block (2), maintaining said movable assembly concentric to the cylinder (2*a*) and in a predetermined axial positioning.

16. The process, as set forth in claim 15, wherein the bearing portion (21, 31) is molded around an adjacent end portion (11*a*, 11*b*) of the resonant spring.

17. The process, as set forth in claim 16, wherein the bearing portion (21, 31) and bearing receiving portion (22, 32) are over-injected on a respective part to which it is provided.

18. The process, as set forth in claim 15, wherein it comprises the additional steps of:

heating at least one of the parts of the fixation face (21*b*, 31*b*) and the junction face (22*b*, 32*b*) of the bearing portion (21, 31) and of one bearing receiving portion (22, 32) to be attached to each other;

positioning said parts to each other, so as to obtain a coaxial positioning of the movable assembly in relation to the cylinder (2*a*);

mutually seating said parts;

compressing said parts of the fixation face (21*b*, 31*b*) and the junction face (22*b*, 32*b*), until obtaining a determined surface fusion thereof, corresponding to the predetermined axial positioning.

19. The process, as set forth in claim 18, wherein it comprises the additional steps of:

providing a heat source (40) between the bearing portion (21, 31) and respective bearing receiving portion (22, 32), prior to the heating of the respective fixation face (21*b*, 31*b*) and junction face (22*b*, 32*b*);

heating said fixation and junction faces (21*b*, 31*b*, 22*b*, 32*b*) until obtaining the fusion thereof, before their mutual seating.

20. The process, as set forth in claim 15, wherein it includes the additional steps of:

providing a fixation element (50) between parts of the bearing portion (21, 31) and the bearing receiving portion (22, 32);

positioning said parts of the bearing portion (21, 31) and the bearing receiving portion (22, 32) to obtain a coaxial positioning of the movable assembly in relation to the cylinder (2*a*);

conducting said parts of the bearing portion (21, 31) and the bearing receiving portion (22, 32) to the mutual seating; and heating said fixation and junction faces (31*b*, 32*b*), until obtaining a fusion thereof around the fixation element (50) and to each other, so as to obtain the predetermined axial positioning between said parts.

21. The process, as set forth in claim 20, wherein the fixation element (50) is made of a material having a high thermal conductibility and having a fusion point superior to that of the parts of the bearing portion (21, 31) and the bearing receiving portion (22, 32), said parts of the bearing portion (21, 31) and the bearing receiving portion (22, 32) being welded to each other by heat emanated from said fixation element (50), which is in turn heated by induction.

* * * * *